US005762563A

United States Patent [19]

Holzhausen

[11] Patent Number: 5,762,563

[45] Date of Patent: Jun. 9, 1998

[54] GOLF HANDGRIP GUIDE

[76] Inventor: Mark Holzhausen, 16155 70th St. N., Loxahatchee, Fla. 33470

[21] Appl. No.: 798,913

[22] Filed: Feb. 12, 1997

[51] Int. Cl.[6] ..... A63B 69/36

[52] U.S. Cl. ..... 473/206; 434/252

[58] Field of Search ..... 473/201, 203, 473/204, 206; 434/252

[56] References Cited

U.S. PATENT DOCUMENTS

| | | | |
|---|---|---|---|
| 715,225 | 12/1902 | Whitner | 473/206 |
| 1,075,054 | 10/1913 | Morley | 423/206 |
| 3,256,023 | 6/1966 | Frazelle | 473/206 |
| 3,806,130 | 4/1974 | Jacques | 473/206 |

*Primary Examiner*—George J. Marlo
*Attorney, Agent, or Firm*—McHale & Slavin

[57] ABSTRACT

A golf handgrip guide for attachment to a conventional golf club grip. The guide is placed over the handle of a golf club and secured thereto by the use of an elastic band. The guide includes adjustable pegs which extend outwardly therefrom for positioning of a golf player's hands according to hand size and the player's left or right-handed grip preference. The guide can be removed from a golf club quickly without tools to make the club suitable for regulation play.

12 Claims, 2 Drawing Sheets

GOLF HANDGRIP GUIDE

FIELD OF THE INVENTION

This invention relates to the game of golf and, in particular, to a golf handgrip guide that attaches to the handle of a golf club, without modification of the golf club, for purposes of teaching a correct and repeatable golfing grip.

BACKGROUND OF THE INVENTION

The game of golf is a well-known sport, having a primary objective of advancing a golf ball around a course using as few strokes as possible. To progress the golf ball, a set of golf clubs typically consisting of fourteen clubs are used. The clubs are divided into two main types: "woods" and "irons." "Woods" are used to drive the ball long distances, while those clubs known as "irons" are used for driving the ball shorter distances with greater accuracy. Club dimensions largely determine the distance and trajectory of the golf ball when it is struck by the club head. For this reason, each club has a distinct head, incline and weight, as dictated by the club's intended use.

One of the challenges of golf is developing a consistent golf swing allowing each of the clubs to deliver the golf ball the distance and hopefully the accuracy intended for the club. Several variables impact the consistency including the straightness of the player's arm during the power stroke of the golf swing. Another variable is player foot placement to help a player strike a golf ball directly. Other variables include club length, club weight ratio, shaft flexibility, and club head speed, just to name a few. Thus, improved proficiency requires the application of a great effort to address each of these commonly-identified variables.

The handgrip is probably the most recognized problem in golf and believed to be the leading cause for to inconsistent play and high scoring Unless a golf club is gripped correctly, the player's arms will be incorrectly positioned resulting in an improper contact with the ball. For example, if a right-handed player holds the golf club with his right hand in an open position, the golf ball tends to "slice" turning to the right upon impact. If a right-handed player holds the club with his right hand in a closed or over center position, the ball tends to "hook" turning left upon impact However, proper placement of the right allows the golf club to swing correctly, causing the golf ball to follow a predicable path.

Placement of the left hand for a right handed player is possibly more important Improper left hand placement may corrupt the club motion, irrespective of the placement of the right hand, for the left hand provides the gripping action for a golf club. Ideally, the hand should compliment each other wherein the right hand should help support the club without guiding it. The above problems apply equally to left-handed players, with substitution of terminology.

To grip a golf club correctly, many players interlock their one finger on one hand to a finger on the other hand. For example a right hand player may hook his left-hand index finger around his right-hand pinky finger. The remaining three left-hand fingers grip the club, and the left-hand thumb merely wraps around the club without applying direct pressure When positioned correctly, the left-hand index finger and thumb form a "V" bisected by the longitudinal axis of the golf club. The right hand is placed over the club to create a desired intertwining of the left and right hands. This places the left-hand thumb within the palm of the right hand and also forms the "V" between the right-hand index finger and the right-hand thumb.

Novice players often have difficulty achieving the proper grip. This difficulty prevents many players from achieving the swing consistency which is so critical to improving playing proficiency. As a result, a number of grip-correcting devices have been developed to teach players how to correctly grip a golf club. The most well-known grip device is a molded grip that is formed integral to a golf club handle. The contours of this molded grip force the player's fingers into a desired orientation in relation to the club.

The molded grip may help correct hand positioning but it is expensive and is not permitted during regulation play. Further, once a player becomes accustomed to molded golf grip, the player may have difficulty switching to a separate set of clubs during regulation play. Even if a player adjusts between molded and non-molded handles without difficulty, two sets of clubs are necessary with one regulation-type grip and another set with a molded handgrip. This is an expensive solution for a set of golf clubs may typically exceed over a thousand dollars in cost. In addition, the molded grip is designed for a single hand size, making it inappropriate for use among players of varied hand sizes. That is, a grip designed for use by a large man would not correctly position the hands of a petite woman.

Other types of grip attachments are also available but due to expense the grip typically addresses just one club. While this approach eliminates the need for two complete sets of clubs, the need to perfect the grip on the range of clubs may be necessary, if not preferable.

Thus, what is lacking in the art is an inexpensive device for teaching handgrip control that may fit any size golf club, adjustable to fit the hand of a particular player, and accommodates a player's left or right-handed grip preference. Additionally, the device needs to be portable and allow for quick attachment and detachment to any club, thereby providing instructional hand guidance when desired.

SUMMARY OF THE INVENTION

The instant invention is a golf handgrip guide consisting of a one-piece, semi-circular sleeve shaped to encompass a portion of a conventional golf club grip. The guide is releasably secured to a golf club by use of a flexible band with the remaining positioning caused by pressure provided through the handgrip. The device includes an adjustable front peg that promotes proper positioning of a golf player's forward hand, for use by either a left or right handed golfer. The forward hand is placed onto the club, with the thumb position on the side of the front peg. The positioning causes a "V" to be formed between the thumb and index finger which is positioned along the longitudinal length of the shaft. For a right-handed player, the right hand is forward, and the left hand should control the swing; for left-handed players, the left hand is forward, and the right hand should control the swing.

The adjustable rear peg is positioned within one of four apertures to accommodate a player's hand grip size. The rear apertures accommodate small, medium, large and extra large hand grips. By placing the rear peg in the appropriate rear aperture, the rear hand is guided to a correct position along the longitudinal length of the club.

In operation, an individual may intend to practice his golf grip before playing a round of regulation golf. The player attaching the golf grip guide to the golf club allowing for warm-up or practice with the device so as to learn proper hand placement Once the player is accustomed to the proper hand placement, the device can be detached from the golf club. During a golf game, the guide can be quickly reattached so a player may recheck his handgrip.

Because this guide can be used on any golf club, it eliminates the need for obtaining multiple grips. That is, the guide can be transferred from one club to another throughout a player's entire set of golf clubs. Additionally, a player may transfer the guide between sets of golf clubs to allow, through adjustment of the rear and front pegs, to allow other players to use the guide on their clubs.

Thus, an object of the instant invention is to teach an inexpensive handgrip guide for use with golf clubs.

Still another object of the instant invention is to teach a handgrip guide which is adjustable for various hand sizes.

Yet still another object of the instant invention is to teach a handgrip guide which accommodates both left-handed and right-handed players.

Still another object of the instant invention is to disclose a handgrip guide that can be used during a golf game with a golfer's regular golf clubs and immediately detached from the golf club without the need for tools.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention The scope of the invention is defined by the claims appended hereto.

Figure 1:
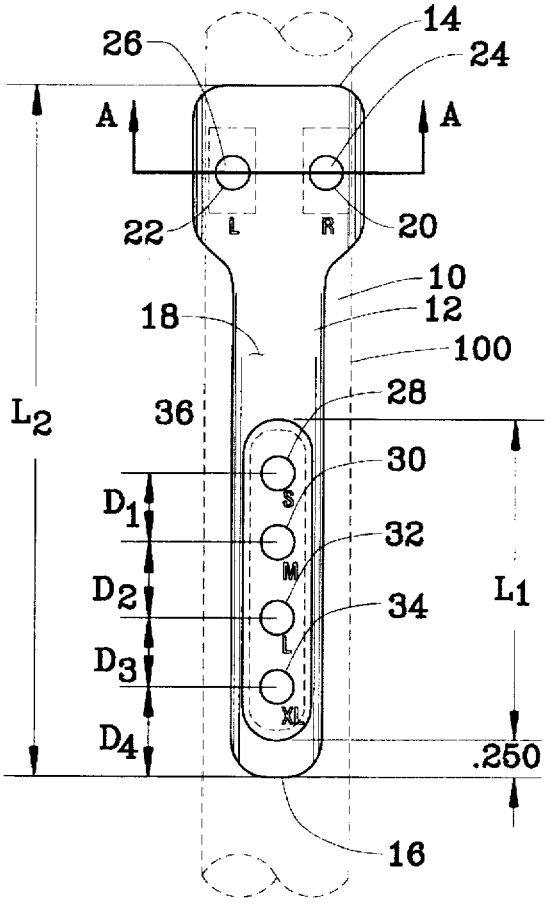
FIG. 1 is a top plane view of the instant invention positioned on a golf club shaft.

Now referring to FIG. 1, the instant invention 10 is illustrated having an elongated sleeve 12 defined by front end 14, back end 16, upper surface 18, and a lower surface, not shown. The sleeve 12 includes front-peg aperture 20 for use by a right-handed golf player and front aperture 22 for use by a left-handed golfer. The lower surface includes a coating designed to raise the coefficient of friction between the lower surface and a golf club.

The front apertures 20 and 22 advantageously allow both left-handed and right-handed players to utilize the device 10. A player inserts a peg 24 through the lower surface of the sleeve 12, to provide a guide for proper positioning of a forward hand. For example, a right-handed player utilizes this device 10 by placing peg 24 through aperture 20 before the sleeve 12 is secured to a golf club handle grip 100 After securing sleeve 12 to the handle 100, by use of an elastic band—not shown, the front peg 24 extends radially from the handle 100 through front aperture 20. In this manner, the golfer may position his thumb around the peg 24 with the "V" formed by the player's right-hand index finger and thumb positioned along the longitudinal length of the shaft. Alternatively, a left-handed player may insert front peg 24 through front aperture 22, to guide the left hand. When the left hand is positioned correctly, front peg 24 prevent the thumb from over extending the shaft.

The back end 16 of the sleeve 12 includes a first rear aperture 28, a second rear aperture 30, a third rear aperture 32, and a fourth rear aperture 34. In this embodiment, the first aperture 28 is for use by an individual having a small grip. Placement of the rear support peg in hole 30 is for use by individuals having a medium grip "M" wherein the hole is positioned further back from the front section 14. Aperture hole 32 is designated for individuals having a large grip "L" further positioning the hands apart whereas hole 34 is designed for an individual having an extra large grip "XL" thereby providing the furthest spacial distance between the driving hand and the support hand. The sleeve includes indicia to mark the designations of the apertures.

The rear peg holder is formed from a raised boss 36 having a length $l_1$, of approximately 1.9 inches. The overall length $l_2$ of the device is approximately 4.1 inches with the spacing between the mounting holes 28 and 30 is $d_1$ of approximately 0.4 inches; between 30 and 32 is $d_2$ approximately 0.4 inches; between 32 and 34 is $d_3$ approximately 0.4 inches with hole 34 brought forward from the rear 16 of the device a distance of $d_4$ approximately 0.6 inches.

Figure 2:
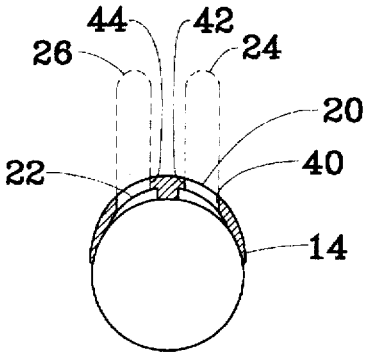
FIG. 2 is a cross-sectional rear view taken along section A—A depicting placement of front alignment pegs.
Figure 3:
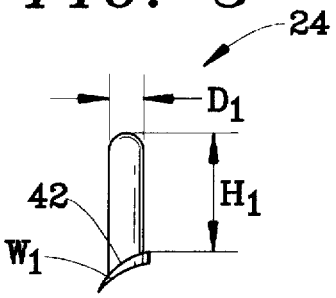
FIG. 3 is a rear view of one of said front pegs.
Figure 4:
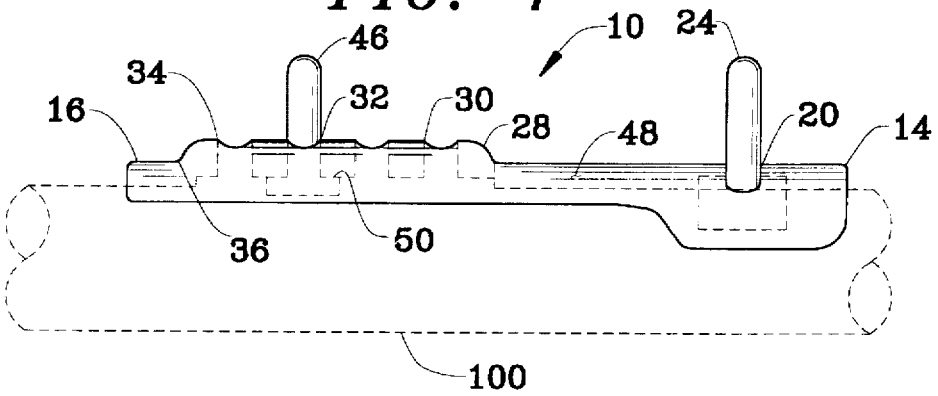
FIG. 4 is a side view of the device positioned over a golf club handle.

Referring now to FIG. 2, a cross-sectional view along section A—A, depicts the semicircular shape approximating 180 degrees with the front portion 14 having front peg 24 placed through aperture 200 The bottom 40 of the peg 24 is chamfered so as to configure to the shape of the base structure employing lip 42 to prevent the peg 24 from being inserted through the aperture 20. Peg 26 is for use by a left handed player and is inserted through slot 22 with lip 44 formed into the peg so as to prevent projection of the peg through the aperture. Peg 26 is of the same shape and design of peg 24 allowing a single peg to be used in either aperture. FIG. 3 depicts the peg 24 having a height hi of approximately 0.69 inches and a diameter $d_1$ of approximately 0.2 inches. The base 42 has a width $w_1$ of approximately 0.292 inches. Now referring to FIG. 4, set forth is a side view of the instant invention 10 depicting rear peg 46 placed through aperture 32 on the raised boss 36. The rear peg 46 is shown in the position for use with large grips spaced apart from peg 24 located along a front portion 14 of the device through aperture hole 20. Preferably, the boss section 36 is molded into the base structure providing a smooth surface leading from the rear portion 16. The front portion of the boss 36 projects to a smooth surface as depicted by numeral 48 allowing for placement of the person's gripping hand.

Figure 5:
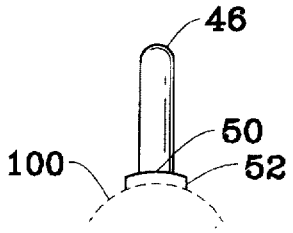
FIG. 5 is a side view of a rear peg.
Figure 6:
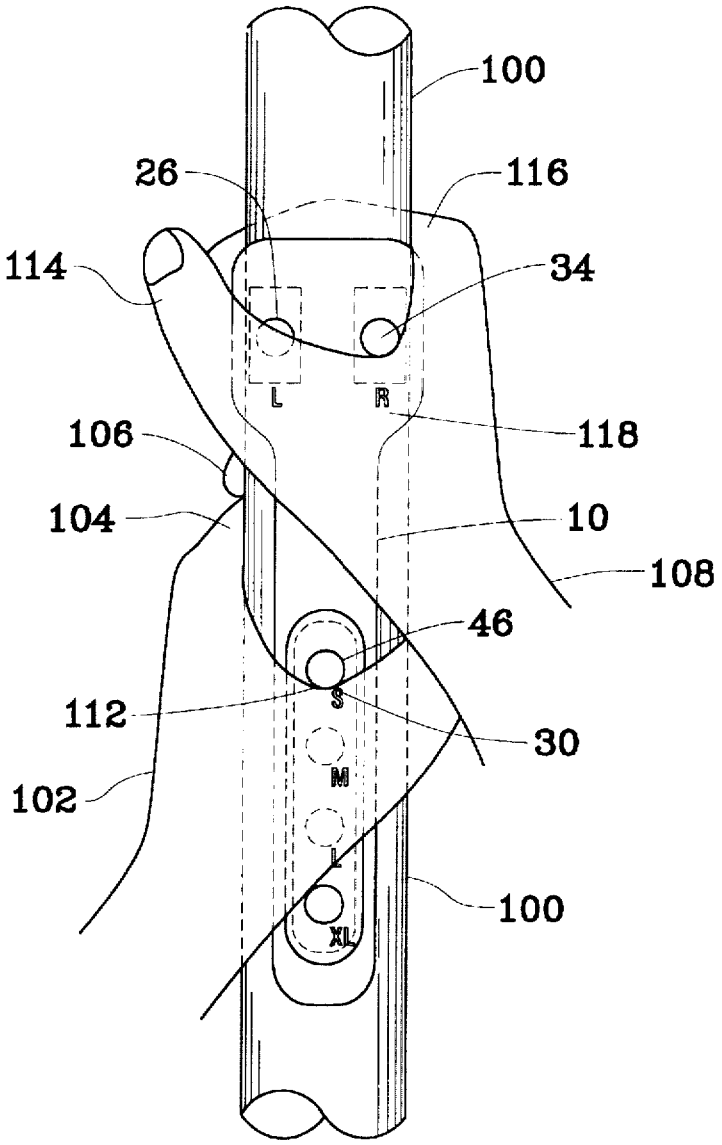
FIG. 6 is a pictorial view of the device attached to a golf club handle with phantom lines depicting an individual's hand grip.

FIG. 5 illustrates the shape of the rear peg 46 having a raised boss 50 that engages a back portion of adjustment slots and having a lower portion 52 having a radii to accommodate the shape of a handle 100 to prevent movement of the peg 46 while in use and prevent a raised section that may cause a marring of the handle Now referring to FIG. 6, set forth is a pictorial view of the instant invention 10 placed on a golf club handle 100. The back peg 46 is shown inserted into the medium aperture spacing 30 wherein the left hand 102 is placed over the club handle with index finger 104 wrapped around the bottom of the club interlocking with the pinky finger 106 of the right hand 108. The index finger 104 and the thumb 110 form a V-shaped intersection 112 which is placed in a line of sight setting between the individual's eyesight and the club head. The V shape forming a directional alignment along the longitudinal length of the club. The right hand 108 having thumb 114 is placed over the club handle 100 with index finger 116 wrapped beneath the club with the other fingers wherein a V-shaped section 118 is formed between the fingers and is positionable around peg 26 of the device 10 also forming a V-shaped alignment section that is placed in a parallel position to the V-shape 112 of the left hand 102 both of which provide a directional placement for positioning of the club and club head.

In use, the individual positions the hands in accordance with the conventional handgrip wherein pegs 46 and 26 cause the actual positioning of the hands in relation to the club head to be in the proper alignment position. The device 10 is releasably secured to the handle 100 by an elastic strap, such as two rubber bands, not shown, that may hook around an extending peg 46 and wraps around the club shaft for securement to the opposite side surface of the peg 46. The U-shaped configuration allows for frictional engagement of the device to the club head and the individual's gripping hand, in this case the left hand, further forces the alignment device to remain in a stationary position allowing the individual to use the club in the normal and conventional manner.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A guide to facilitate proper hand placement on a golf club, said guide comprising: an elongated, golf club-handle-conforming sleeve having a longitudinal length defined by an upper surface, a lower surface, a front and back end, said front end having a first and second front aperture each oriented perpendicular to said longitudinal length and passing orthogonally through said front end and a plurality of rear apertures spaced along said longitudinal length juxta-positioned to said back end; a front peg to sized engage said first or second front aperture, said front peg extending from said upper surface of said sleeve when said front peg is inserted through said lower surface of said sleeve; a rear peg sized to engage one of said rear apertures, said rear peg extending from said upper surface of said sleeve when said rear peg is inserted into said lower surface of said sleeve; and a means for securing said sleeve to a golf club, whereby said guide promotes correct positioning of an individual's hands to a golf club.

2. The guide of claim 1, wherein said means for securing is an elastic band sized to wrap around said golf club for securing said sleeve thereto.

3. The guide of claim 1 further including a coating disposed on said lower surface of said sleeve, said coating designed to raise the coefficient of friction between said lower surface of said sleeve and said golf club.

4. The guide of claim 1, wherein including indicia placed permanently on said upper surface of said sleeve.

5. The guide of claim 1, wherein said rear apertures is further defined as a first rear aperture spaced a first distance from said end for use by an individual having a small handgrip, a second rear aperture spaced a second distance from said end for use by an individual having a medium handgrip, a third rear aperture spaced a third distance from said end for use by an individual having a large handgrip, a fourth rear aperture spaced a fourth distance from said end for use by an individual having an extra-large handgrip, each of said apertures being circular and having a center which lies on the longitudinal axis of said sleeve, whereby an individual places said rear peg into either said first, second, third or fourth position according to handgrip size.

6. The guide of claim 1, wherein a cross-section passing through of said sleeve defines an arc which spans approximately 180 degrees.

7. The guide of claim 1, wherein said back end has a thickness that is greater than the thickness of said front end.

8. The guide of claim 1, wherein each said front aperture includes a peg-notch located on said lower surface for receipt of said front peg and prevent rotation thereof.

9. The guide of claim 1, wherein each said rear aperture includes a peg-notch located on said lower surface for receipt of said rear peg and prevent rotation thereof.

10. A guide to facilitate proper hand placement on a golf club, said guide comprising: an elongated, golf club-handle-conforming sleeve having a longitudinal length defined by an upper surface, a lower surface, a front and back end, said front end having a first and second front aperture each oriented perpendicular to said longitudinal length and passing orthogonally through said front end and a plurality of rear apertures spaced along said longitudinal length juxta-positioned to said back end; a front peg to sized engage said first or second front aperture, said front peg extending from said upper surface of said sleeve when said front peg is inserted through said lower surface of said sleeve; a peg-notch located on said lower surface for receipt of said front peg to prevent rotation of said peg; a rear peg sized to engage one of said rear apertures, said rear peg extending from said upper surface of said sleeve when said rear peg is inserted into said lower surface of said sleeve; said rear aperture includes a peg-notch located on said lower surface for receipt of said rear peg to prevent rotation of said peg; indicia placed permanently on said upper surface of said sleeve to designate said apertures, and an elastic band sized to wrap around said golf club for securing said sleeve thereto; whereby said guide promotes correct positioning of an individual's hands to a golf club.

11. The guide of claim 10 further including a coating disposed on said lower surface of said sleeve, said coating designed to raise the coefficient of friction between said lower surface of said sleeve and said golf club.

12. The guide of claim 10, wherein said rear apertures is further defined as a first rear aperture spaced a first distance from said end for use by an individual having a small handgrip, a second rear aperture spaced a second distance from said end for use by an individual having a medium handgrip, a third rear aperture spaced a third distance from said end for use by an individual having a large handgrip, a fourth rear aperture spaced a fourth distance from said end for use by an individual having an extra-large handgrip, each of said apertures being circular and having a center which lies on the longitudinal axis of said sleeve, whereby an individual places said rear peg into either said first, second, third or fourth position according to handgrip size.

* * * * *